US005456200A

United States Patent [19]

Shen

[11] Patent Number: 5,456,200

[45] Date of Patent: Oct. 10, 1995

[54] RUDDER FOR REDUCED CAVITATION

[75] Inventor: Young T. Shen, Potomac, Md.

[73] Assignee: The United States of America as represented by the Secretary of the Navy, Washington, D.C.

[21] Appl. No.: 426,752

[22] Filed: Apr. 21, 1995

Related U.S. Application Data

[63] Continuation-in-part of Ser. No. 135,526, Oct. 13, 1993, Pat. No. 5,415,122.

[51] Int. Cl.[6] ..... B63H 25/06

[52] U.S. Cl. ..... 114/162

[58] Field of Search ..... 114/162, 163, 114/165, 167; 440/66

[56] References Cited

U.S. PATENT DOCUMENTS

| | | | |
|---|---|---|---|
| 1,699,931 | 1/1929 | Tutin | 114/162 |
| 1,705,133 | 3/1929 | Oertz | 114/162 |
| 1,714,042 | 5/1929 | Oertz | 114/162 |
| 1,744,138 | 1/1930 | Oertz | 114/162 |
| 1,844,303 | 2/1932 | Wagner | 114/162 |
| 1,973,783 | 9/1934 | Thornsen | 114/162 |
| 2,331,706 | 10/1943 | Livingston | 114/162 |
| 2,392,165 | 1/1946 | Livingston | 114/162 |

*Primary Examiner*—Edwin L. Swinehart
*Attorney, Agent, or Firm*—Gary G. Borda

[57] ABSTRACT

Ship rudders are subjected to propeller induced velocities and induced flow angles that vary along the rudder span and chord. Because of non-zero onset flow angles, a suction pressure peak is formed at or near the leading edge of the rudder where early cavitation occurs. The present invention is directed to a rudder and method for minimizing early cavitation and related ship vibration and for thus improving acoustic and hydrodynamic performance thereof. The rudder of the present invention is twisted so as to have profiles along its entire span that are aligned with propeller induced non-zero onset flow angles into the rudder. The twist of the rudder sections vary in the spanwise direction, that is, the twist angle of one rudder sections may vary relative to the twist angle of adjacent or remaining rudder sections, such that the rudder experiences substantially zero angles of attack along the span from the rudder's root to the rudder's tip. Moreover, each individual rudder section may be twisted in the chordwise direction to substantially align the individual sections with the incoming flow along the entire chord from the rudder's leading edge to the rudder's trailing edge.

8 Claims, 12 Drawing Sheets

NACA PROFILE

ADVANCED SECTION PROFILE

RUDDER FOR REDUCED CAVITATION

STATEMENT OF GOVERNMENT RIGHTS

The invention described herein may be manufactured and used by or for the Government of the United States of America for governmental purposes without the payment of any royalties thereon or therefor.

CROSS REFERENCE TO RELATED APPLICATIONS

The present case is a continuation-in-part of application Ser. No. 08/135,526 filed on Oct. 13, 1993.

BACKGROUND OF THE INVENTION

1. Field of the Invention

This invention relates to rudders for naval and commercial vessels and more particularly relates to a rudder and method for minimizing early cavitation and related ship vibration and for thus improving maneuverability thereof.

2. Review of Related Art

Rudders provide a vessel with directional stability, control, and maneuverability. Ship rudders are generally vertical hydrofoils with symmetric profiles, i.e., horizontal cross-sections symmetric about the profile longitudinal centerline (chord) as shown by conventional rudder 26 in FIGS. 1–3. Rudders generate hydrodynamic lift forces to produce ship turning moments for maneuvering and directional control. The lift force produced varies with the rudder's angle of attack (angle of the rudder chord relative to the onset flow angle) and the incoming flow velocity (velocity of flow into the rudder). The effectiveness of rudders in performing their hydrodynamic functions is proportional to the square of the incoming flow velocity, thus, rudders are generally placed behind propellers where the incoming flow is accelerated by the rotating propeller.

In existing rudder design practice, virtually unchanged since the 1940's, naval architects and marine engineers initially determine the overall rudder size (rudder chord, i.e., longitudinal distance from leading edge to trailing edge, and rudder span, i.e., vertical distance from root to tip) based on consideration of the ship's required turning diameter and thus required turning moment. Rudder section profiles are then selected from sections of the National Advisory Committee for Aeronautics (NACA) such as NACA 4-digit profiles (e.g., NACA 0020) or from alternative section profiles such as TMB-EPH (elliptic-parabolic-hyperbolic) sections.

These conventional rudders are located either along the ship centerline directly behind the propeller, in the case of a single shaft designs, or behind the propellers and positioned symmetrically about the ship's longitudinal centerline in the case of a multiple shaft designs. Thus, the rudders are located in the propeller slip stream or trailing wake, i.e., accelerated flow in the propeller wake. The propeller slip stream is a region of highly complex flow having axial, tangential and radial flow components. The rotating propeller accelerates the flow and sheds vortices that impinge on the rudder surface. Consequently, a rudder operating behind a rotating propeller encounters, in addition to the flow at substantially the ship's velocity (ship wake), vortices shed by and induced velocity generated by the propeller (propeller trailing wake). Depending on the propeller's size, hydrodynamic loading and position relative to the rudder, the incoming flow to the rudder exhibits induced flow angles (onset flow angles) that can vary longitudinally along the chord of the rudder (chordwise) and vertically along the span of the rudder (spanwise).

Because the propeller accelerates and rotates the flow into the rudder and because the vortices shed from the propeller impinge on the rudder surface, the flow entering the rudder plane exhibits larger onset flow angles (angles of incoming flow relative to the ship longitudinal centerline) than would result without the propeller present. Due to the complexity of flow field in the propeller slip stream, the influence of accelerated cross-flow induced by the propeller onto the rudder is not considered in existing rudder design practice. The simple conventional rudder design practice, however, results in problems in terms of rudder performance.

As a result of the propeller generating non-zero onset flow angles in the rudder plane, rudders with symmetric profile sections placed parallel to the ship centerline experience non-zero angles of attack and generate hydrodynamic lift and induced drag, even if the ship is operating in a straight ahead course. Because of non-zero onset flow angles, suction pressure peaks (highly decreased pressure) occur at or near to the leading edge of the rudder. Surface cavitation can be predicted from the pressure distribution on the rudder surface. Cavitation inception occurs when local pressure drops to or below the local vapor pressure of the flowing fluid. Therefore, in areas of suction pressure peaks early cavitation inception can occur on the rudder.

Because of the leading edge suction pressure peaks produced by the large propeller induced angles of attack experienced by conventionally designed rudders, early cavitation inception occurs at the rudder leading edge. Viewing the rudder and propeller from behind the ship, a right-hand rotating (clockwise rotating) propeller will produce flow having velocity components directed to the right of the propeller centerline while left-hand rotating (counterclockwise rotating) propellers will direct components of flow to the left of the propeller centerline. Therefore, depending on the direction of propeller rotation and, thus, the direction of induced flow angle into the rudder, cavitation may occur on either the inboard or outboard side of the rudder in twin shaft designs.

Early rudder cavitation results in an undesirable compromise in hydrodynamic and acoustic performance of the vessel. Specifically, rudder cavitation induces unsteady hydrodynamic forces, vibration, and rudder erosion. The existence of non-zero onset flow angles also reduces the available rudder angles for avoiding rudder stall at low speeds. Furthermore, the induced drag from the finite lift force and the form drag from the rudder cavity create additional ship resistance.

Ship rudders are subjected to propeller induced velocities and induced flow angles that vary along the rudder span and chord. Because of non-zero onset flow angles, a suction pressure peak is formed at or near the leading edge of the rudder where early cavitation occurs. It would, therefore, be advantageous to both hydrodynamic and acoustic performances to alleviate the occurrence of suction pressure peaks and early cavitation. Thus, there is clearly a need to improve rudder cavitation inception speed (i.e., delay cavitation inception) and to improve hydrodynamic and acoustic performances of rudders.

SUMMARY OF THE INVENTION

It is accordingly an object of this invention to provide an improved rudder having higher cavitation inception speed and thus improved hydrodynamic and acoustic performances.

It is another object to provide a method for increasing the cavitation inception speed of a rudder.

It is a further object to improve the hydrodynamic and acoustic performances of a ship's rudder.

It is an additional object to provide quieter ship operation, reduced cavitation erosion, reduced rudder drag, and delayed rudder stall.

It is a still further object to provide this improved rudder with no cost penalty in fabrication as compared to traditional rudders.

It has been discovered that these objects can be met by providing a rudder having chordwise profiles (i.e., generally airfoil shaped longitudinal cross-sections) that are twisted so as to be aligned with the direction of flow (onset flow angles) into the rudder plane from the propeller. The twist of the rudder sections vary in the spanwise direction, that is, the twist angle of one rudder sections may vary relative to the twist angle of adjacent or remaining rudder sections, such that each twisted rudder sections experiences small (less than 2 degrees) or zero angles of attack along the entire span from the rudder's root to the rudder's tip. Moreover, each individual rudder section may be twisted in the chordwise direction to substantially align the individual sections with the incoming flow along the entire chord from the rudder's leading edge to the rudder's trailing edge. With numerical cutting machines becoming standard features in industries, there is no cost penalty in fabrication of the twisted rudder of the present invention as compared to a standard non-twisted rudder.

Surface cavitation occurs on conventional rudders when increased flow angles generate suction pressure peaks. Rudder cavitation can be minimized or suppressed by the rudder of the present invention. Accordingly, in one aspect of the present invention, a rudder for operation in a fluid flow behind a rotating propeller is provided. The rotating propeller imparts induced flow angles to the flow. The induced flow angles into each rudder profile define the onset flow angles into that profile. The rudder includes a leading edge and a trailing edge that define a chord and a root and a tip that define a span. The chord and span define a curved locus of points. The rudder further includes a plurality of cross-sectional chordwise profiles having arcuate surfaces extending between the leading and trailing edges. The profiles are spaced in the spanwise direction and define the rudder shape. Each of the profiles has a mean chordline that defines an angle of attack of the profile relative to the onset flow angle into the profile. Each individual rudder profile is substantially aligned with the incoming flow such that the mean chordline of each individual profile is aligned with the onset flow angles into that profile. That is, each of the mean chordlines defines a curved line wherein tangent lines at a plurality of points along each of the mean chordlines define substantially 0° angles relative to the onset flow angle at corresponding points of the mean chordlines. Moreover, each of the profiles is faired into adjacent profiles such that the profiles define a faired rudder shape having no sharp discontinuities between adjacent profiles. Consequently, each profile along the entirety of the span experiences a substantially zero angle of attack. Thus, suction pressure peaks on the rudder are minimized or suppressed and the rudder exhibits increased cavitation inception speed, improved hydrodynamic and acoustic operation, reduced cavitation erosion, and delayed rudder stall.

In a further aspect of the present invention, a method for twisting a rudder to substantially align the rudder with a direction of a fluid flow into the rudder and thus to increase the cavitation inception speed of a rudder and minimize unsteady hydrodynamic forces due to cavitation on a rudder operating in a propeller slip stream is provided. The resulting twisted rudder, which has a chord and a span that define a curved locus of points, is located substantially about a vertical plane aft of a ship propeller and operates in a fluid flow behind the rotating propeller that imparts to the fluid flow induced flow angles that vary in the spanwise and chordwise direction in the vertical plane. The induced flow angles define the onset flow angles into the rudder. The method of the present invention includes the steps of: a) providing a plurality of untwisted rudder profiles extending between a leading edge and a trailing edge, each of the profiles having an untwisted mean chordline, the untwisted profiles spaced in a spanwise direction of the vertical plane and defining an untwisted rudder shape; b) providing a matrix of points in the vertical plane, the matrix comprising a plurality of points in each of the untwisted profiles such that the matrix defines a plurality of spanwise points and a plurality of chordwise points in the vertical plane, each of the untwisted profiles having associated therewith a thickness measured normal to the untwisted mean chordline at each of the plurality of points, the thickness varying between the leading edge and the trailing edge, each of the plurality of points defining a rotation point, the rotation points including a forward most rotation point and an aft most rotation point, each of the rotation points defining a corresponding rotation axis perpendicular to the profile at the rotation point; c) determining the onset flow angle behind the rotating propeller at each of the points in the matrix; and d) rotating each of the untwisted profiles sequentially from the forward most rotation point to the aft most rotation point about the corresponding rotation axes such that a rotated mean chordline is formed thereby and wherein a tangent to the rotated mean chordline at each of the rotation points defines a twist angle. The resulting twist angles are substantially equal to the onset flow angles at corresponding rotation points such that each of the rotated mean chordlines are substantially aligned with the direction of the fluid flow at each of the corresponding points in the matrix. The rotating step forms a plurality of rotated profiles that define the twisted rudder. Each of the forward most rotation points may have a chordwise location between the leading edge and 30% of the chord behind the leading edge and each of the aft most rotation points may have a location between the trailing edge and 30% of the chord forward of the trailing edge.

Additionally, each of the rotated profiles has associated therewith a rotated thickness measured normal to the rotated mean chordline at each of the rotation points. The rotated thickness measured normal to the rotated mean chordline at each of the rotation points is equal to the thickness measured normal to the untwisted mean chordline at each of the plurality of points. That is, the rudder thickness prior to the rotating step is maintained after the rotating step. The instant method results in each rotated mean chordline being substantially aligned with the direction of the fluid flow at each of the plurality of points in the profile. In so doing, each profile experiences a substantially zero angle of attack over the entirety of the matrix.

DESCRIPTION OF THE PREFERRED EMBODIMENTS

Figure 1:
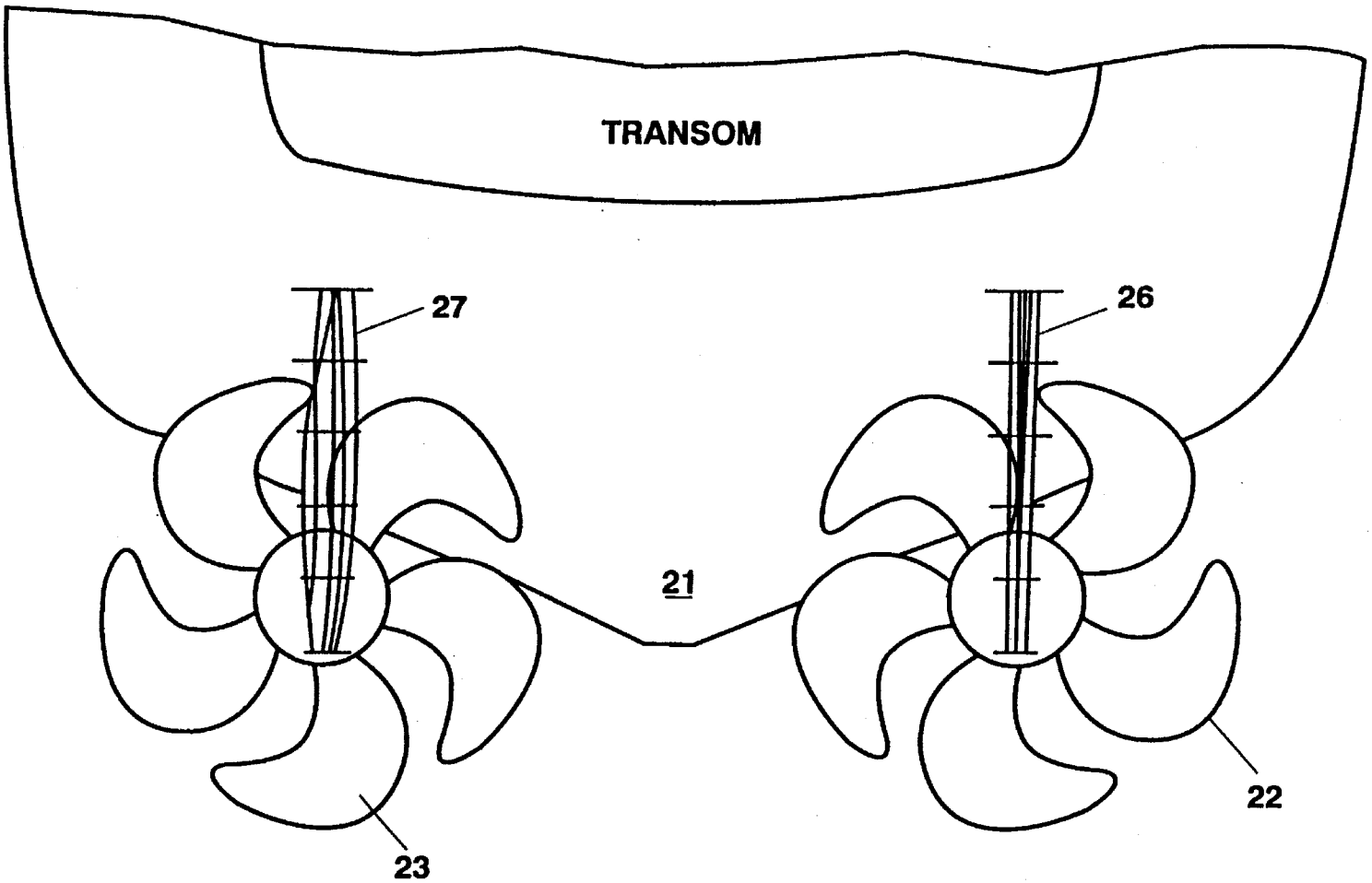
FIG. 1 is a view looking from behind of a ship equipped with twin propellers, a twisted rudder on its port side, and a conventional rudder on its starboard side.
Figure 2:
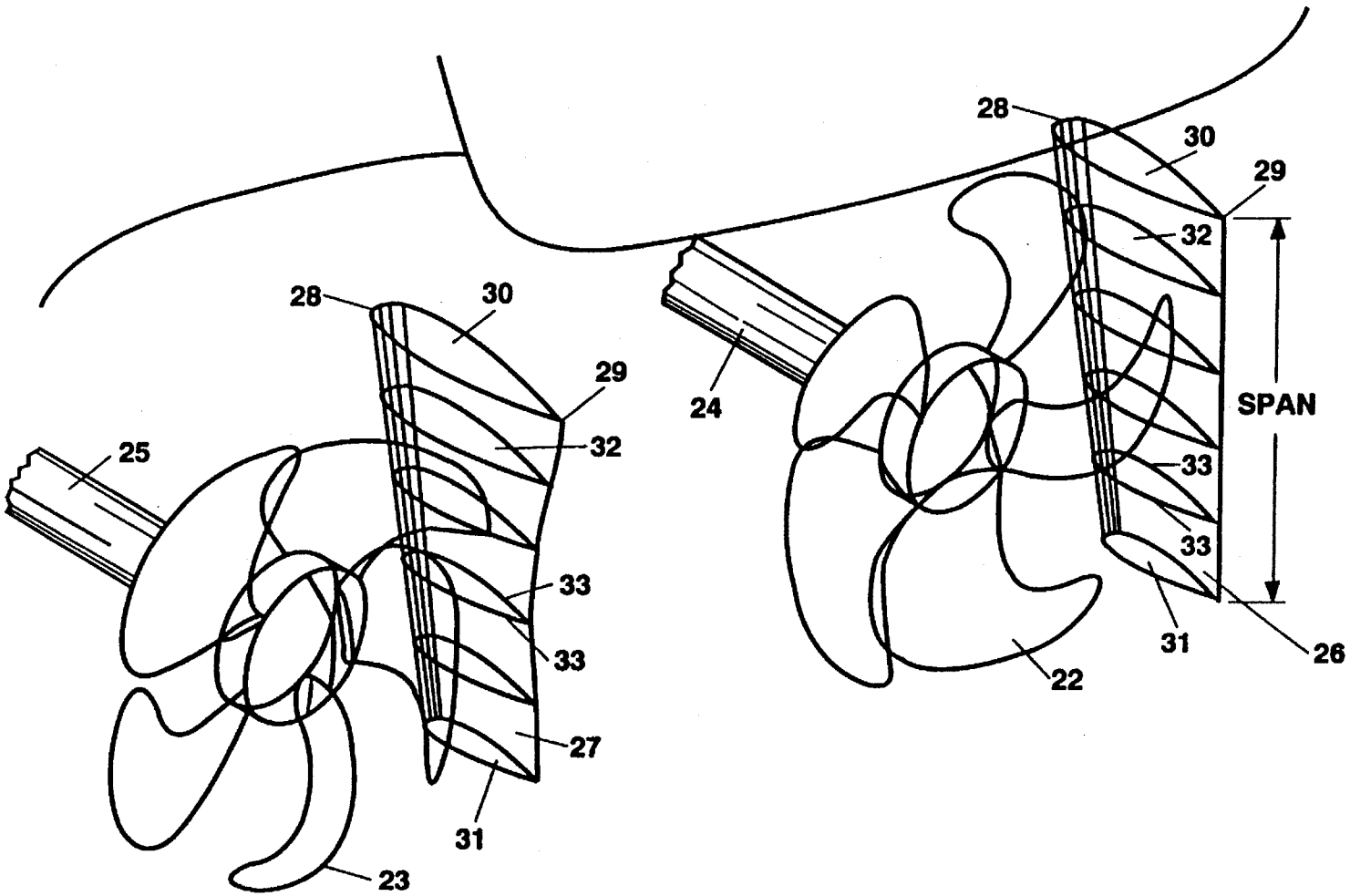
FIG. 2 is an isometric view of the ship stern of FIG. 1.
Figure 3:
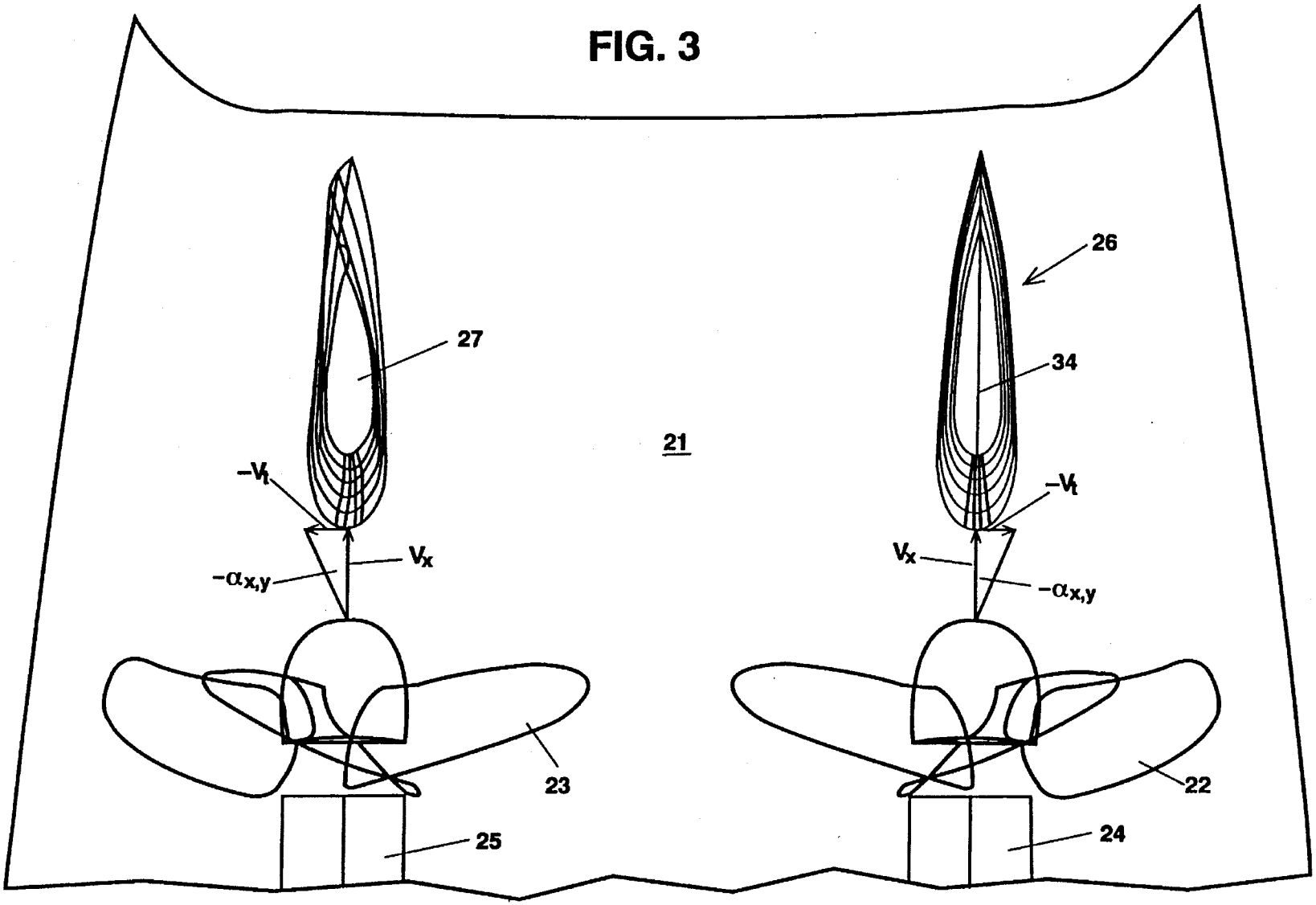
FIG. 3 is a bottom view of the ship stern of FIG. 1.

As shown in FIGS. 1, 2, and 3, a vessel stern 21 is equipped with a pair of oppositely-rotating propellers 22, 23 rotatably mounted on respective propeller shafts 24, 25 and a pair of rudders 26, 27 which are aligned with propellers 22 and 23. Rudder 26 is a conventional rudder, while rudder 27 is an example of a twisted rudder of the present invention. Twisted rudder 27 of the present invention need not be located in line with the propeller centerline as shown in FIGS. 1, 2 and 3, but may be inboard or outboard of the propeller centerline. Furthermore, the present invention applies equally as well to single shaft vessels as it does to multiple shaft vessels.

In one aspect of the present invention, twisted rudder 27 for minimizing or suppressing rudder cavitation is provided. In this aspect, profiles 32 of twisted rudder 27 are twisted so as to be aligned with the direction of flow, as defined by onset flow angles ($\alpha_{X,Y}$) into the rudder plane from propeller 23. The twist of profiles 32 may vary in the spanwise direction, that is, the twist angle of one profile may vary relative to the twist angle of adjacent or remaining profile, such that each profile 32 experiences small (less than 2 degrees) or zero angles of attack along the entire span. Moreover, each individual rudder profile 32 may be twisted in the chordwise direction to substantially align the individual profiles with the incoming flow along the entire chord from the rudder's leading edge to the rudder's trailing edge. All intervening rudder sections are faired into the rotated profiles 32 to produce a faired rudder surface.

Twisted rudder 27 operates in the fluid flow behind rotating propeller 23. Rotating propeller 23 imparts induced flow velocity and induced flow angles to the flow into twisted rudder 27. As depicted in FIG. 3, and more fully discussed below, the flow generated by propeller 23 has velocity components in the axial ($V_x$) and tangential ($V_t$) directions thus resulting in induced flow angles. The induced flow angle into each rudder profile defines the onset flow angle ($\alpha_{X,Y}$) into that profile. Twisted rudder 27 includes leading edge 28 and trailing edge 29 that define a chord and root 30 and tip 31 that define a span. In conventional untwisted rudder 26, the chord and span define a flat locus of points, i.e., a flat two-dimensional rudder plane. Contrariwise, in twisted rudder 27 of the present invention, the chord and span define a curved locus of points, i.e., a curved plane in three-dimensional space. Twisted rudder 27 further includes a plurality of cross-sectional chordwise profiles 32 having arcuate surfaces 33 extending between leading edge 28 and trailing edge 29. Profiles 32 are spaced in the spanwise direction of the rudder plane and define the shape of twisted rudder 27. Each profile 32 has a mean chordline 34 (also see FIGS. 5A and 5B) that defines an angle of attack of the profile relative to $\alpha_{X,Y}$ into the profile. The angle of attack of profile 32 is the angle between mean chordline 34 and $\alpha_{X,Y}$ at any particular point along the chord. Assuming that $\alpha_{X,Y}$ is constant in the chordwise direction, then if profile 32 is symmetric about mean chordline 34, the mean chordline will be a straight line and the angle of attack will be constant along the chord. However, if profile 32 is cambered, the mean chordline will be curved and the local angle of attack (angle between a tangent to the curved mean chordline 34a and the onset flow angle) may vary from point to point along the chord.

However, in actual practice $\alpha_{X,Y}$ usually varies in the chordwise direction. Therefore, in accordance with the present invention, each profile 32 is substantially aligned with the incoming flow such that mean chordline 34 of each profile 32 is substantially aligned with $\alpha_{X,Y}$ into that profile. Consequently, each profile 32 along the entirety of the span experiences a substantially zero angle of attack.

In one embodiment of twisted rudder 27, each profile 32 is rotated about a rotation point located on its mean chordline 34 such that a line drawn tangent to mean chordline 34 at the rotation point is substantially aligned with the onset flow angle into profile 32. Thus, profile 32 experiences a substantially zero angle of attack in the vicinity of the rotation point and very small angles of attack over its entire chord. If profile 32 is symmetric, then mean chordline 34 is substantially aligned with the onset flow angle, i.e., mean chordline 34 defines a substantially 0° angle relative to the onset flow angle at the rotation point.

As discussed earlier, induced angles of attack produce suction pressure peaks. The pressure distribution and location of suction pressure peaks and, thus, location of cavitation inception on the rudder surface, can be predicted. Therefore, by locating the rotation point in the area where cavitation inception is first predicted to occur, the local angle of attack and resulting suction pressure peaks can be minimized or suppressed. Generally, suction pressure peaks are located near the leading edge of the rudder. Thus, the rotation point is preferably located between leading edge 28 and 30% of mean chordline 34 behind leading edge 28.

Figure 13A:
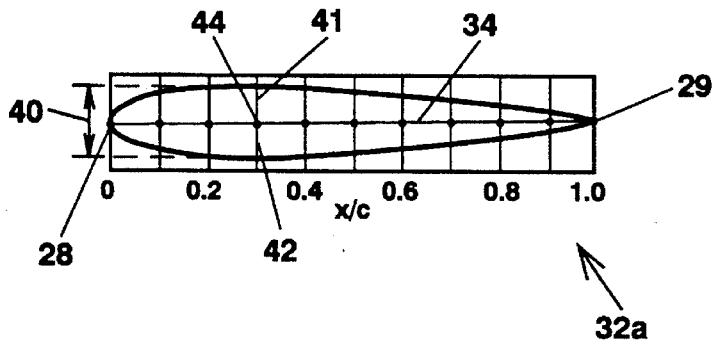
FIGS. 13A, 13B and 13C provide a graphic representation of the method of the present invention.
Figure 13B:
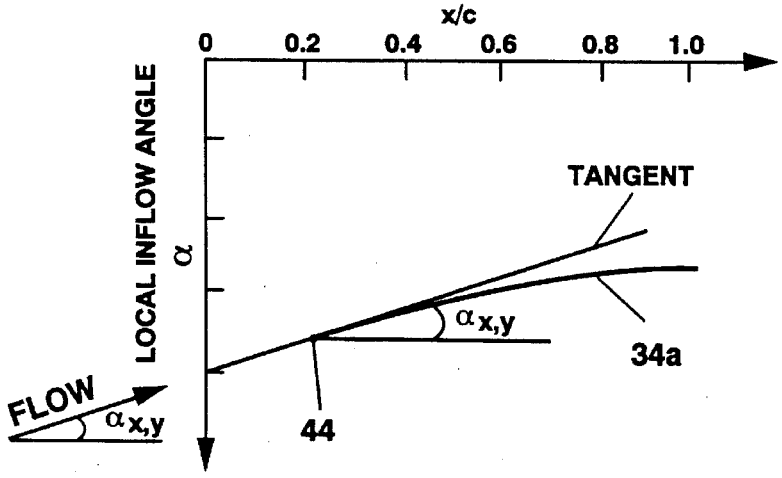
Figure 13C:
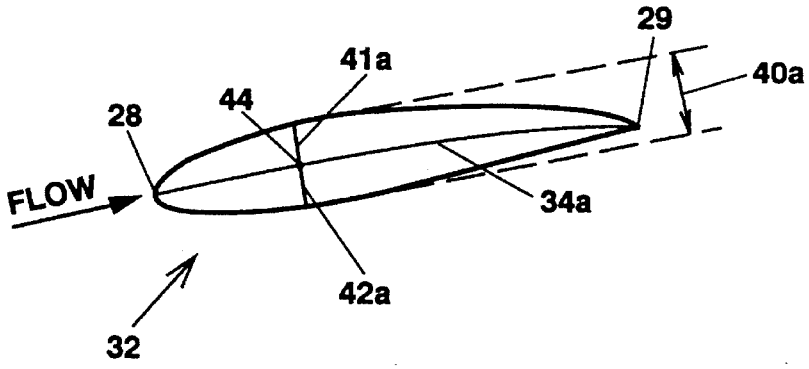

In a further embodiment, as shown in FIGS. 13A, 13B and 13C, twisted rudder 27 has profiles 32 that are twisted in the chordwise direction of the rudder plane such that mean chordline 34*a* of each of profiles 32 is aligned with the onset flow angle into that profiles at a plurality of points between leading edge 28 and trailing edge 29. In this embodiment, mean chordline 34*a* will be curved and a line drawn tangent to mean chordline 34*a* at any of the plurality of points along the chord will define an angle substantially equal to the onset flow angle ($\alpha_{X,Y}$) at that point. Thus, profiles 32 are twisted in the chordwise direction (as opposed to being rotated about a single rotation point) and the twist of the profiles 32 may vary in the spanwise direction relative to adjacent or remaining profiles according to the spanwise variation in onset flow angle ($\alpha_{X,Y}$). Consequently, twisted rudder 27 experiences a substantially zero angle of attack over the entirety of the rudder plane.

Figure 5A:
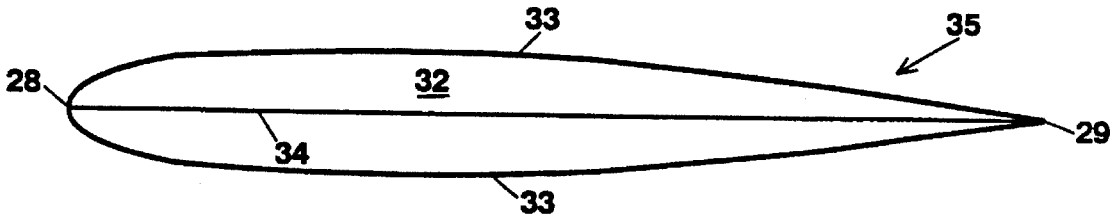
FIGS. 5A and 5B are exemplary views of an airfoil section profile and an advanced section profile, respectively.
Figure 5B:
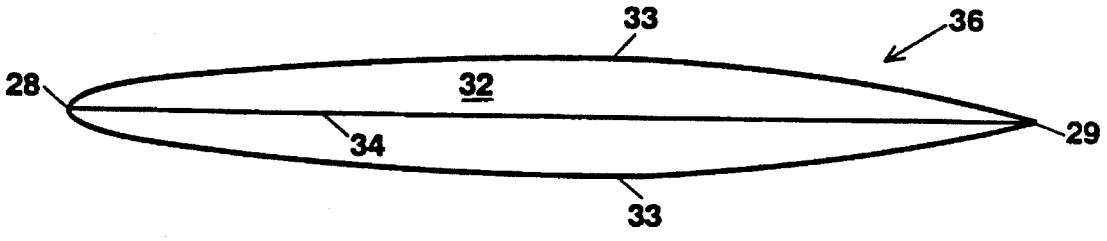

FIGS. 5A and 5B show exemplary representations of profiles 32 of twisted rudder 27. Profile 32 has leading edge 28, trailing edge 29 and arcuate surfaces 33 therebetween. Mean chordline 34 extends between leading edge 28 and trailing edge 29 through the center of profile 32 (i.e., midway between arcuate surfaces 33). Thus, arcuate surfaces 33 are generally symmetric surfaces as depicted in the figures. However, profiles 32 may be a cambered section (need not be symmetric about their mean chordlines).

In one preferred embodiment, profile 32 may be an airfoil section 35 as in FIG. 5A. Airfoil section 35 represents a NACA 0012 profile, however, any airfoil section is applicable to the present invention. Alternatively, profile 32 may be an advanced section profile 36 as in FIG. 5B. FIG. 5B is an exemplary representation of a family of sections referred to herein as "advanced section profiles."

Herein, the term "advanced section profile" is defined to mean a section profile as described and formulated in three published papers: [1] Eppler, Richard and Young T. Shen, "Wing Sections for Hydrofoils-Part 1: Symmetrical Profiles," Journal of Ship Research, Vol. 23, No. 3, Sept. 1979, pp. 209–217; [2] Shen, Young T. and Richard Eppler, "Wing Sections for Hydrofoils-Part 2: Nonsymmetrical Profiles," Journal of Ship Research, Vol 25, No. 3, Sept. 1981, pp. 191–200; and [3] Bailar, J. W., S. D. Jessup and Y. T. Shen, "Improvement of Surface Ship Propeller Cavitation Performance Using Advanced Blade Sections," Proceedings of the Twenty-Third American Towing Tank Conference, 1993, pp. 185–193. The third listed reference also describes design procedures incorporating the advanced profile sections resulting in blade (or rudder) geometry. Such methods of designing propeller blades, airfoils, hydrofoils, and rudders are well known in the art and will not be described herein. Advanced profile sections 36 applicable to twisted rudder 27 are designed with camber and thickness distributions to produce a specified profile pressure distribution that results in improved cavitation inception.

In a further aspect of the present invention, as shown in FIGS. 13A, 13B and 13C, a method for increasing the cavitation inception speed of a rudder and, thus, for minimizing unsteady hydrodynamic forces due to cavitation on a rudder operating in a propeller slip stream is provided. The twisted rudder, as represented by rudder 27 in FIGS. 1–3, is located substantially about a vertical plane aft of a ship propeller and has a chord and a span that define a curved locus of points. Rudder 27 operates in a fluid flow behind a rotating propeller that imparts to the fluid flow induced flow angles that may vary in the spanwise and chordwise direction. The induced flow angles define the onset flow angles ($\alpha_{X,Y}$) into the rudder. The method of the present invention includes the steps of:

a) providing a plurality of untwisted rudder profiles 32*a* extending between a leading edge 28 and a trailing edge 29, each of the untwisted profiles 32*a* having a mean chordline 34, the untwisted profiles 32*a* spaced in a spanwise direction of the vertical plane and defining an untwisted rudder shape;

b) providing a matrix of points in the vertical plane, the matrix comprising a plurality of point in each of the untwisted profiles 32*a* such that the matrix defines a plurality of spanwise points and a plurality of chordwise points in the vertical plane, each of the untwisted profiles 32*a* having associated therewith a thickness 40 measured normal to the mean chordline 34 at each of the plurality of points, the thickness 40 varying between the leading edge 28 and the trailing edge 29 (thickness 40 includes upper thickness 41 above mean chordline 34 and lower thickness 42 below mean chordline 34) each of the plurality of points defining a rotation point 44, the rotation points 44 including a forward most rotation point and an aft most rotation point, each of the rotation points 44 defining a corresponding rotation axis perpendicular to the profile at the rotation point 44;

c) determining the onset flow angle behind the rotating propeller at each of the points in the matrix; and d) rotating each of the untwisted profiles 32*a* sequentially from the forward most rotation point to the aft most rotation point about the corresponding rotation axes such that a rotated mean chordline 34*a* is formed thereby and wherein a tangent to rotated mean chordline 34*a* at each of the rotation points 44 defines a twist angle, the resulting twist angles being substantially equal to the onset flow angles ($\alpha_{X,Y}$) at corresponding rotation points 44 such that each of rotated mean chordlines 34*a* are substantially aligned with the direction of the fluid flow at each of the corresponding points in the matrix. Additionally, each of the rotated profiles 32 has associated therewith a rotated thickness 40*a* measured normal to the rotated mean chordline 34*a* at each of the rotation points 44 (thickness 40*a* includes upper thickness 41*a* above rotated mean chordline 34*a* and lower thickness 42*a* below rotated mean chordline 34*a*). The rotated thickness 40*a* at each of the rotation points 44 is equal to the thickness 40 measured normal to the mean chordline 34 at each of the plurality of points in untwisted profile 32*a* (i.e., upper thickness 41*a* is equal to upper thickness 41 and lower thickness 42*a* is equal to lower thickness 42). The rotating step results in a plurality of rotated profiles that define twisted rudder 27.

The instant method results in each resulting chordline 34*a* being aligned with the direction of the fluid flow at each of the points in the matrix. In so doing, each profile experiences a substantially zero angle of attack over the entirety of the matrix. The profiles appropriate for the instant method are as described above for profiles 32 of twisted rudder 27.

In one embodiment, the matrix may comprise a single point in each of the profiles. The points are substantially aligned in the spanwise direction and, thus, defines a single substantially spanwise line in the rudder plane. Each matrix point defines a rotation point. As discussed above, the rotation points are preferably located in the area where cavitation inception is first predicted to occur. The rotation points are preferably located between the leading edge and 30% of the mean chordline behind the leading edge. In this case, the twisting step comprises rotating each profiles about its rotation point.

In a further embodiment, the matrix comprises a plurality of points in each of the profiles such that the matrix defines a plurality of spanwise points and a plurality of chordwise points. Determining the number of points in the matrix is within the skill of a hydrodynamicist/rudder designer of ordinary skill and may be based on such factors as the ascertained flow variation into the rudder or the cost and fabrication of the finished rudder. In this embodiment, each profile is twisted in the chordwise direction such that a line drawn tangent to the chordline at any matrix point along the chord will define an angle equal to the calculated onset flow angle at that matrix point. Furthermore, profile twist may vary among profiles in the spanwise direction according to the spanwise variation of the calculated onset flow angles.

The embodiments of the present invention have been presented and discussed in terms of a substantially vertical rudder. However, one skilled in the art will recognize that the present invention applies equally as well to non-vertically aligned rudders. The twisted rudder of the present invention may be constructed of any material appropriate for use in a marine environment, such as, strong, corrosion resistant metals, metal composites, or fiber-reinforced organic composite materials.

The propeller slip stream or trailing wake constitutes vortices shed by the propeller and flow accelerated and rotated by the propeller. Rudders 26 and 27 operate in this flow. To effectively twist the rudder so as to align it with the onset flow angles requires advance knowledge of cross-flow in the propeller slip stream and velocity components in the rudder plane. Methods of determining onset flow angles in the rudder plane behind a rotating propeller are well known to the naval architect and hydrodynamicist of ordinary skill. Knowledge of velocity components in the rudder plane can be obtained in a number of ways, including by both experimental and computational methods. The flow field in the rudder plane can be determined experimentally through wake surveys, flow visualization, or other techniques well known in the art. Experimental wake survey measurements of the velocity components in the rudder plane can be made using, for example, a laser doppler velocimetry (LDV) system, five-hole pitot tubes, or flow flags mounted behind a ship model in a towing tank or water tunnel. However, these experimental methods can be expensive and time consuming and require prior knowledge of the ship configuration (e.g., rudder plane location) and operational profile (e.g., ship speed and propeller advance coefficient). Alternatively, many well known and commercially available computer programs are used in the ship/aircraft design field to determine flow characteristics computationally. Computer programs are available for predicting free-field velocity distributions in steady or unsteady flow. The use of computer programs has the advantage that variables may be easily modified.

The twisted rudder having improved cavitation inception speed of the present invention can be designed using any of a number of well known computer programs for computing airfoil or propeller performance and predicting free-field velocity distributions. Examples of such numerical programs include VSAERO and MIT PSF 10. These programs, which employ panel methods to model the propeller and incompressible potential flow theory to compute velocity distributions, are well known in the art and will not be described in detail here. VSAERO is available from Analytical Methods, Inc. of Redmond, Washington 98052, and is described in an AMI Report entitled "PROGRAM 'VSAERO' A Computer Program for Calculating the Nonlinear Aerodynamic Characteristics of Arbitrary Configurations," prepared by B. Maskew under Contract NAS2-11945 for NASA Ames Research Center (December 1984). MIT PSF 10, available from the Massachusetts Institute of Technology, is described in Massachusetts Institute of Technology Doctoral dissertation entitled, "Development and Analysis of Panel Methods for Propeller Unsteady Flow," by Ching-Yeh Hsin (1990). These particular programs compute velocity profiles in the propeller plane but may be easily modified by a computer programmer of ordinary skill, as detailed below, to compute the velocity components in the rudder plane. By accounting for propeller induced acceleration and rotation imparted to the flow into the rudder, a more accurate prediction of the flow field in the rudder plane is obtained.

For purposes of example, a modification of MIT PSF 10 employed by the inventor will be described. MIT PSF 10, is used by the Navy to evaluate propeller performance in a steady flow. Input data include propeller blade and hub geometry, ship wake velocity components in the propeller plane (typically obtained from wake surveys measurements in the propeller plane behind a ship model in the absence of a propeller), and propeller advance coefficient. The program provides free-field velocity distributions in the near vicinity of the propeller plane in terms of cylindrical coordinates fixed to a rotating propeller blade and predicts hydrodynamic forces and pressure distributions on the rotating propeller hub and blades. The program, as written, calculates flow characteristics around a ship hull including propeller induced effects, but only outputs the results of those calculations near the propeller plane. The output routine was modified to output the calculated velocity distributions a greater distance downstream of the propeller and with respect to a coordinate system fixed to the rudder, rather than the propeller.

Since MIT PSF 10 provides velocity distributions in the rotating propeller plane, the program was modified to provide velocity distributions upstream and downstream of the propeller and, thus, determine velocity distributions in the rudder plane. Because, the velocity distributions in the rudder plane is desired, the output coordinate system for the velocity components was modified from a cylindrical coordinate system fixed to a rotating propeller blade to a Cartesian coordinate system fixed in space relative to the rudder plane. From the calculated velocity distributions in the rudder plane, onset flow angles in the rudder plane are determined.

Figure 4A:
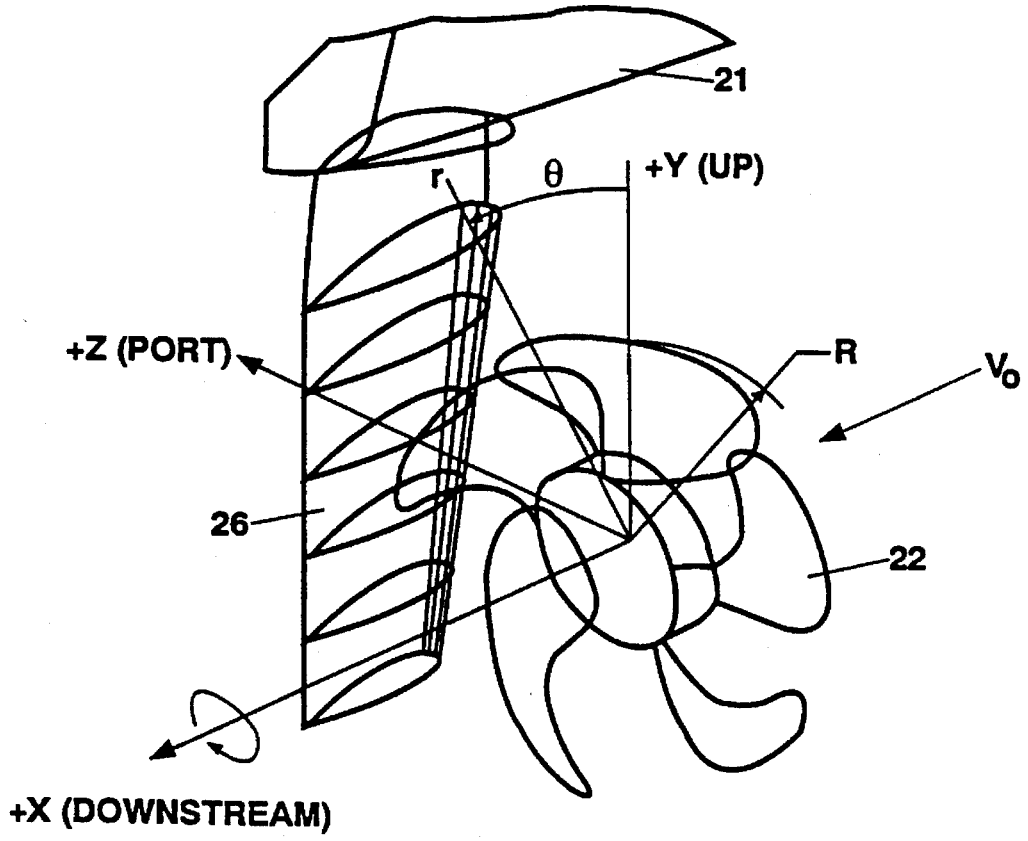
FIG. 4A is an isometric view of a propeller and a rudder and representative coordinate system axes therefor.
Figure 4B:
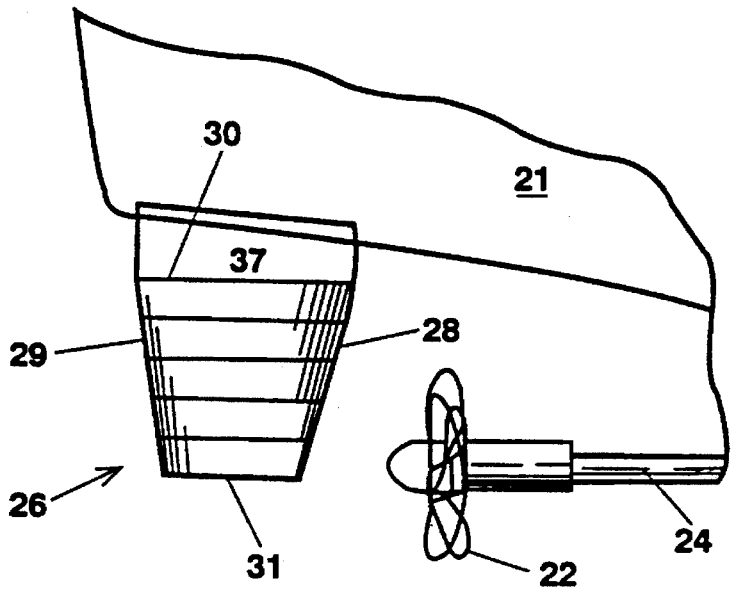
FIG. 4B is a side view of a propeller and a rudder mounted on the stern of a ship.

The coordinate system and sign convention, according to MIT PSF 10 as modified, are shown in FIGS. 4A and 4B in which a five-bladed propeller 22 on a shaft 24 is aligned with a conventional rudder 26 which is attached to ship stern 21. Fixed rudder stool 37 is used in conventional hulls to fair rudder 26 into hull 21. FIG. 4A shows cylindrical coordinates X, r and $\Theta$, and Cartesian coordinates X, Y and Z, in the propeller plane. The symbol $\Theta$ denotes blade angular position with the angle increasing in the opposite direction of propeller rotation. X, Y, and Z are the fixed Cartesian coordinates, with X increasing downstream (aft), Y increasing upward and Z increasing to port. In the rudder plane, X denotes the axial (chordwise) scale and Y denote the vertical (spanwise) scale.

Velocity distributions from the modified computer code were compared to velocity distributions measured in a 24-inch water tunnel with very good results. The results indicate that the novel approach to determining the flow field affecting rudder operation, including the flow field induced by the rotating propeller, is soundly conceived.

Wake survey experiments were conducted by S. Jessup in the 24 inch variable pressure water tunnel at the David Taylor Model Basin, Carderock Division Headquarters, Naval Surface Warfare Center in Bethesda, MD. The velocity distributions were measured upstream and downstream of two 12 inch diameter model propeller: a three-bladed propeller, designed for uniform flow with no skew or rake, and a five-bladed propeller characteristics of a typical modern marine propeller having a large hub and a nonlinear skew distribution. There were no simulated ship wake and propeller shaft inclination was zero. Thus, the flow into the propeller plane was uniform. Time averaged velocities in the propeller flow field were measured with a three-component laser doppler velocimetry (LDV) system. Mean and rms velocities were calculated and plotted. Experimental and computational results are shown in FIGS. 6–10 as a validation of the present methodology.

Comparisons of normalized time averaged velocity distributions in the tangential and axial directions, computed (COMPUTATIONAL) and measured (EXPERIMENTAL), are presented in FIGS. 6–10. In these Figures and the following discussion, R is the propeller radius, D is the propeller diameter, J is the propeller advance coefficient, n is the propeller rotational speed, X denotes axial distance from the propeller plane with positive being downstream, r denotes the radial distance from the propeller rotational centerline, $V_o$ denotes the reference speed (ship or tunnel speed), $V_x$ denotes axial velocity with positive being downstream, and $V_t$ denotes tangential velocity with positive being in the direction of positive Θ (opposite direction of propeller rotation).

Figure 6A:
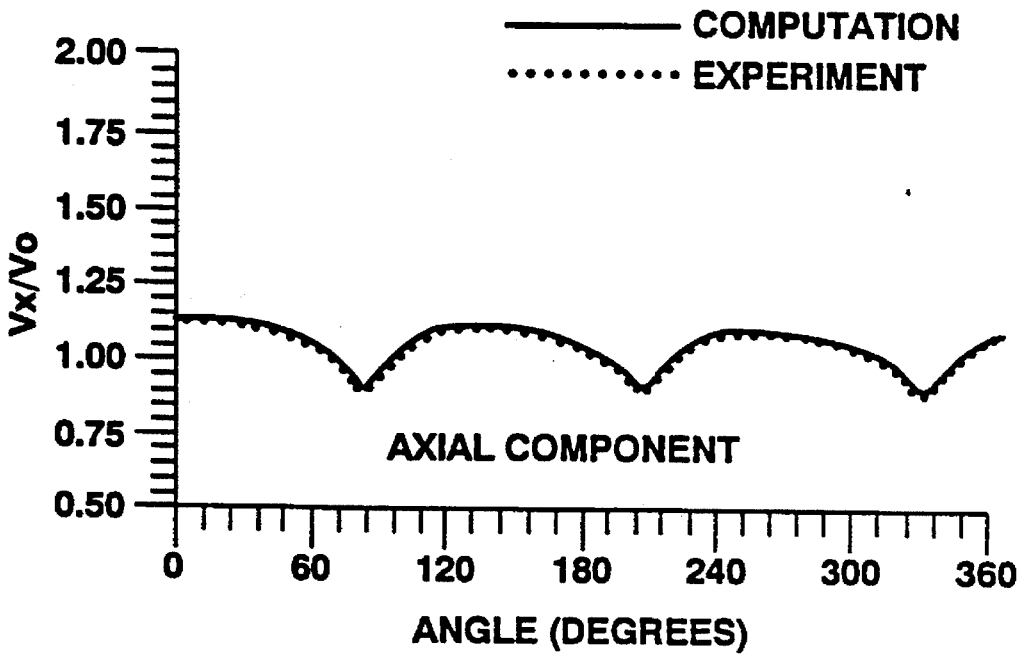
FIGS. 6A and 6B contain graphs of experimentally measured and computed axial and tangential velocity components ahead of a three-bladed propeller at J=0.806, X/R=−0.3, and r/R=0.7.
Figure 6B:
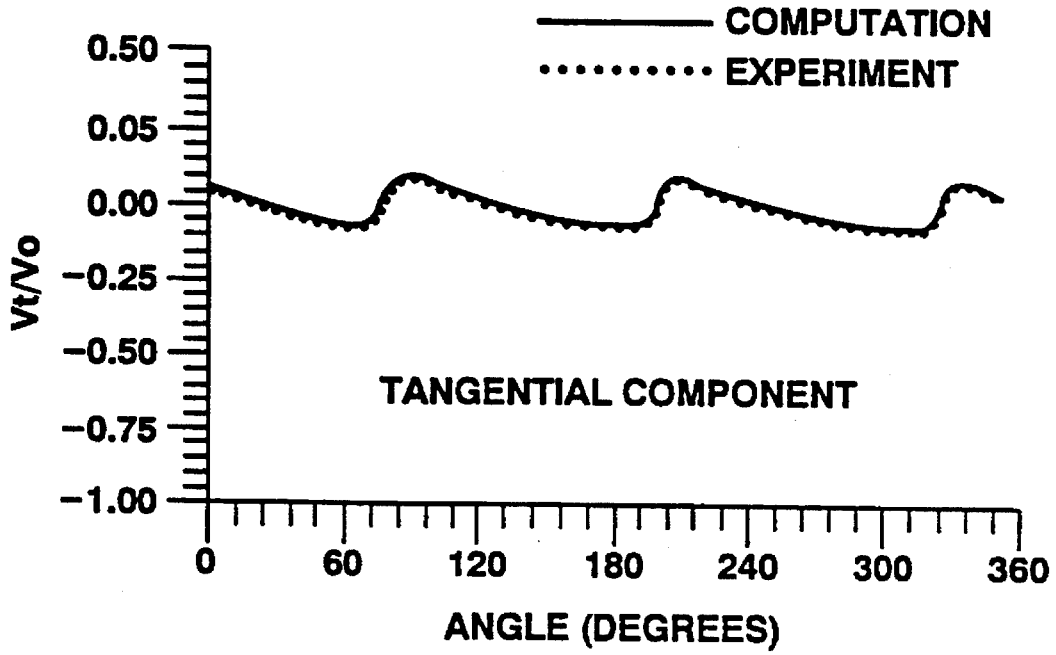

Results for the three-bladed propeller at an axial location of X/R=–0.3 (upstream of the propeller), a radial location of r/R=0.7, and a propeller advance coefficient $J=V_o/nD=0.806$ are shown in FIG. 6. Because the propeller has three blades, the measured and computed velocity components behind the propeller exhibit three-cycle variation along the circumferential plane. The agreement between measured and computed values is very good, indicating that the mathematical model is adequately predicting the physical phenomenon.

Figure 7A:
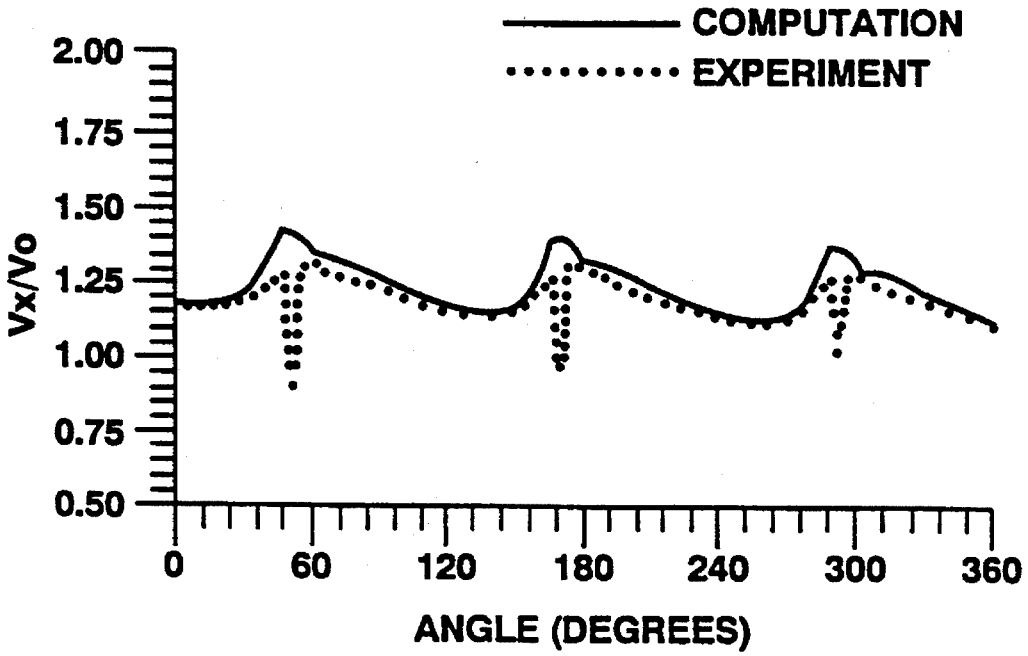
FIGS. 7A and 7B contain graphs of experimentally measured and computed axial and tangential velocity components behind a three-bladed propeller at J=0.806, X/R=0.295, and r/R=0.7.
Figure 7B:
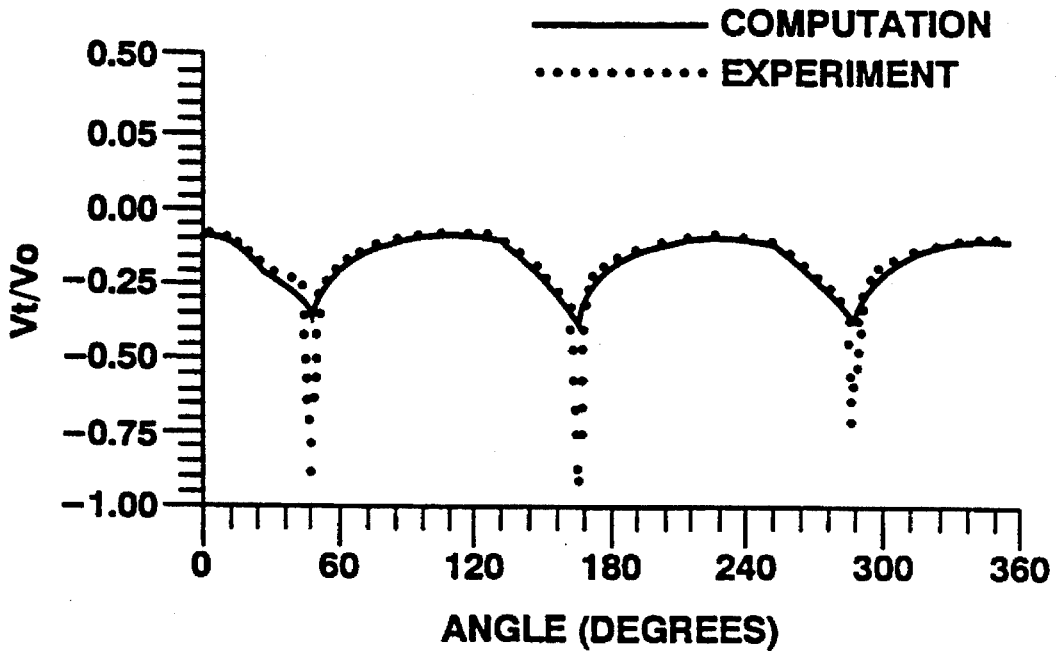

Results for the three-bladed propeller at an axial location of X/R=0.295 (downstream of the propeller), a radial location of r/R=0.7, and J=0.806 are shown in FIG. 7. As the flow passes through a propeller blade, a viscous wake is generated and a spike or local peak is formed in the test data as seen in FIG. 7. The mean axial velocity ratio is on the order of 1.25, indicating that the axial velocity in a propeller slip stream is greater than the velocity entering the propeller. Thus a rudder in the propeller wake will encounter a velocity that is greater than that of the advancing vessel.

Except in the neighborhood of the viscous wake, computations are in good agreement with measurements. It should be noted that the viscous wake decays very fast. For example, at a distance downstream of X/R>1.0, the viscous wake is almost negligible. On the other hand, the potential wake decays very slowly, and it is the potential wake that has a significant effect on rudder performance. The tapered leading edge of most conventional rudders are located at approximately X/R of 1.3 to 1.4. Because the influence of viscous wake on rudder performance is expected to be small, the difference between measured and computed values at the peak regions is consequently of no practical concern. Comparisons were also made between measured and computed values at several other upstream and downstream positions and at several radial locations, with similar results as shown in FIGS. 6 and 7.

Figure 8A:
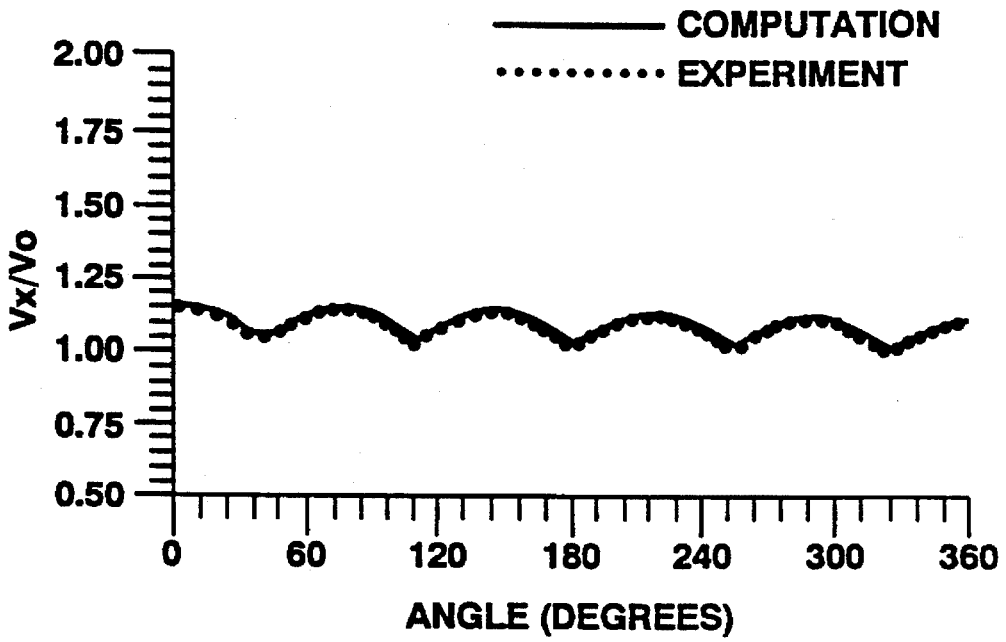
FIGS. 8A and 8B contain graphs of experimentally measured and computed axial and tangential velocity components ahead of a five-bladed propeller at J=0.886, X/R=−0.334, and r/R=0.772.
Figure 8B:
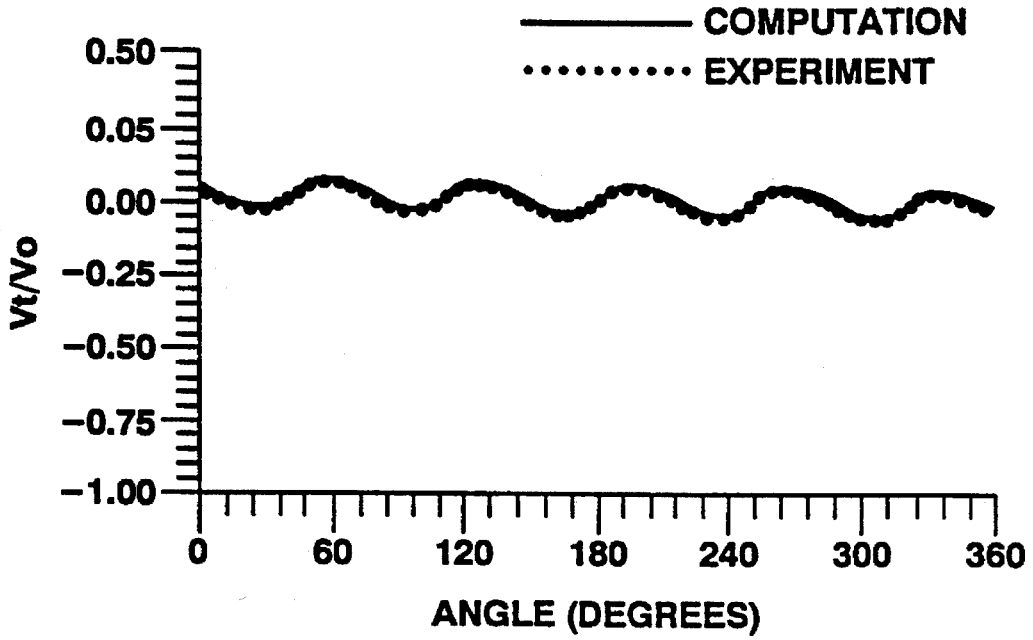

Results for the five-bladed propeller at an axial location of X/R=–0.334 (upstream of the propeller), a radial location of r/R=0.772, and J=0.886 are shown in FIG. 8. Because the propeller has five blades, the data exhibit five-cycle variation. The agreement between measured and computed values is very good.

Figure 9A:
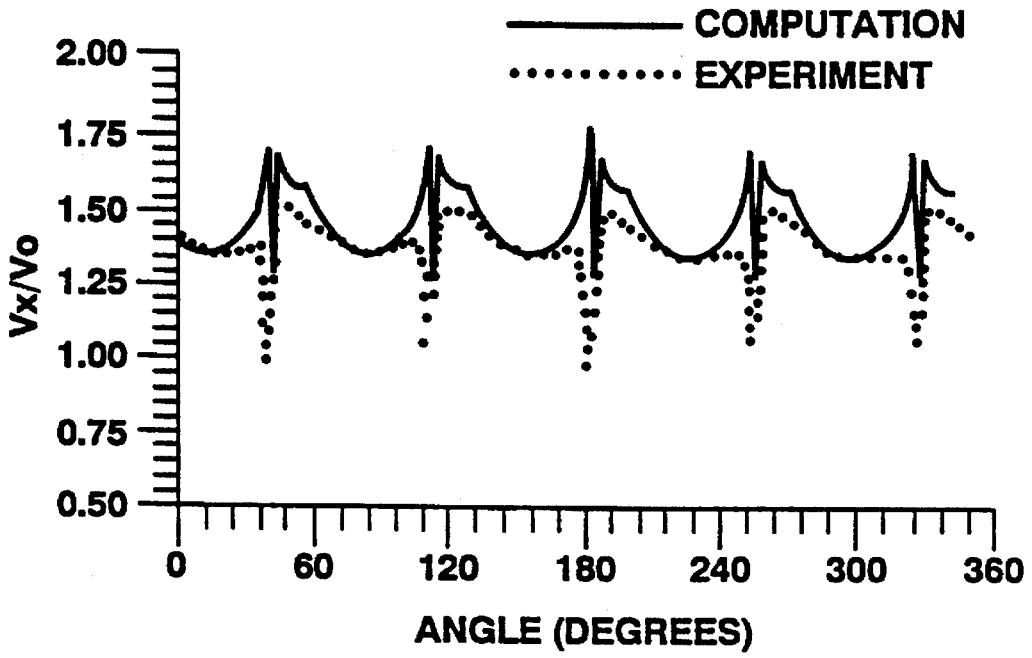
FIGS. 9A and 9B contain graphs of experimentally measured and computed axial and tangential velocity components behind a five-bladed propeller at J=0.886, X/R=0.334, and r/R=0.772.
Figure 9B:
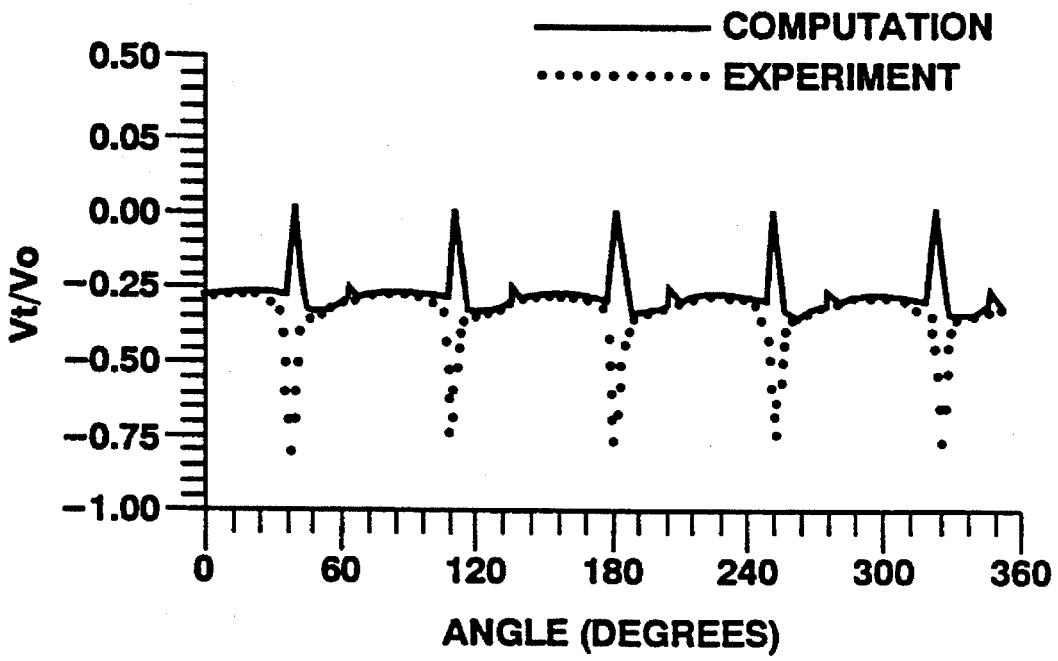
Figure 10A:
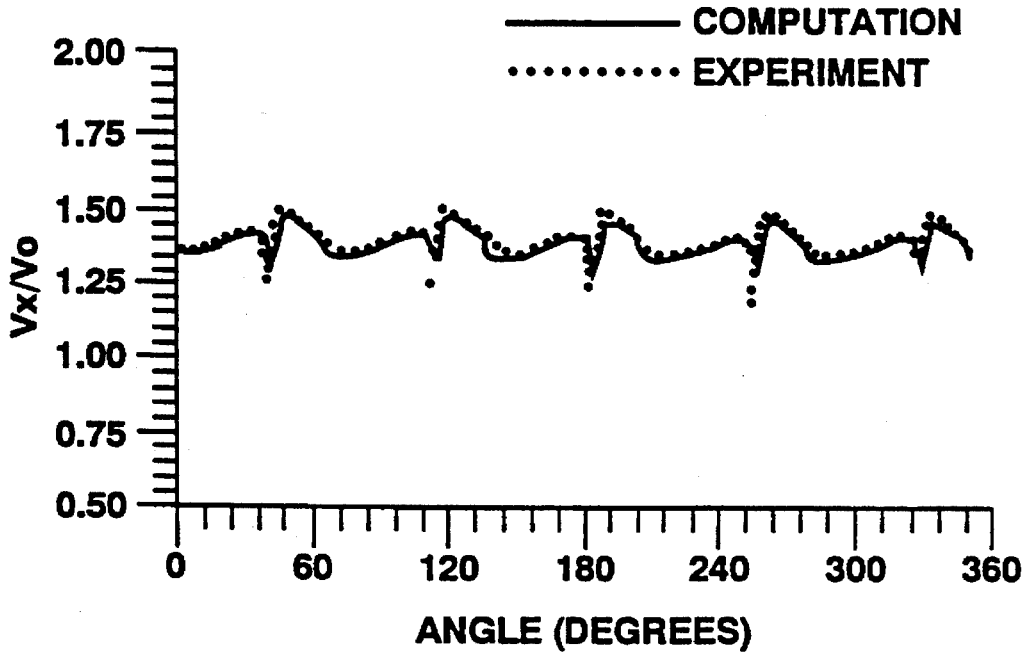
FIGS. 10A and 10B contain graphs of experimentally measured and computed axial and tangential velocity components behind a five-bladed propeller at J=0.886, X/R=0.334, and r/R=0.572.
Figure 10B:
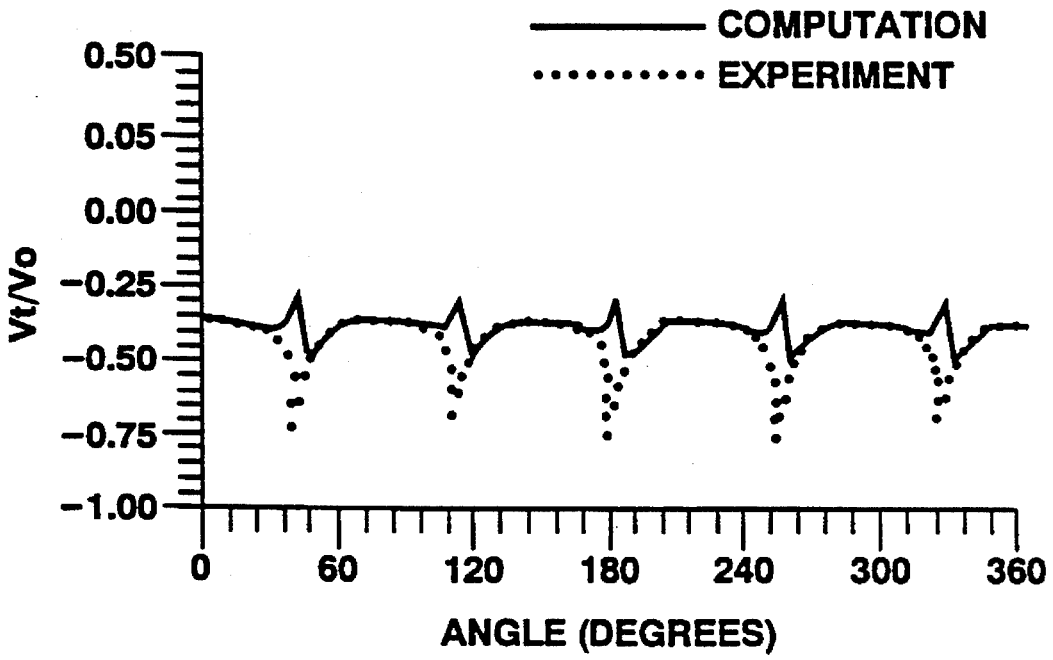

Results for the five-bladed propeller at an axial location of X/R=0.334 (downstream of the propeller), J=0.886 and radial locations of r/R=0.772 and 0.552 are shown in FIGS. 9 and 10, respectively. The mean axial velocity is on the order of 1.50 which is substantially greater than the tunnel velocity. Except in the neighborhood of viscous wake, the computations are in good agreement with measurements.

The lift force produced by the rudder is dependent on the rudder's angle of attack. Airfoil theory shows that the velocity component in the radial direction has a minimal effect on lift force. Consequently, the onset flow angle $\alpha_{X,Y}$ into the rudder plane at any X,Y location can be determined from the axial ($V_x$) and tangential ($V_t$) velocity components at any axial (chordwise) location X/R and vertical (spanwise) location Y/R as the arc tangent of ($V_t/V_x$). The direction of $+V_x$ is downstream or in the aft direction. For right-handed propeller rotation (clockwise rotation when viewing the propeller from behind the vessel), the direction of $+V_t$ is to the right of the direction of $+V_x$. Thus, a $+\alpha_{X,Y}$ is to the right of the direction of $+V_x$. Using this sign convention values of $V_t$ are usually negative, thus, values of $\alpha_{X,Y}$ will also usually be negative. In other words, when viewing the vessel from behind, a right-handed (clockwise) rotating propeller will induce an onset flow angle, $\alpha_{X,Y}$, to the right of the ship centerline, while a left-handed (counterclockwise) rotating propeller will induce an onset flow angle, $\alpha_{X,Y}$, to the left of the ship centerline.

The following examples present measured and calculated velocity components and calculated onset flow angles. The calculated values were obtained using MIT PSF 10 as modified by the inventor.

EXAMPLE 1: Uniform Flow

FIG. 9 presents computational and experimental results for a five-bladed propeller in uniform flow at X/R=0.334, r/R=0.772 and J=0.886. The experimentally measured time averaged velocity ratios in the axial direction, $V_x/V_o$, and the tangential direction, $V_t/V_o$, are 1.5 and –0.26, respectively. Consequently, the onset flow angle, $\alpha_{X,Y}$, entering the plane at X/R=0.334 and r/R=0.772 is $$\alpha_{X,Y}=\text{arc tangent}(-.26/1.5)=-.38°$$

Thus, a rudder at a distance of X/R=0.334 from the propeller plane would experience an onset flow angle of $\alpha_1=-9.38°$ into the profile located at r/R=0.772. Such a large onset flow angle would produce a large hydrodynamic force even if a symmetric rudder was placed parallel to the ship centerline. A sharp suction pressure peak would be generated around the rudder leading edge and the rudder would easily experience leading edge cavitation. The consequences include compromise of ship hydrodynamic operation (loss of maneuvering capability) and acoustic operation (increased noise), ship vibration, cavitation erosion, and early rudder stall.

Example 2: Behind a Vessel

Computed propeller induced velocities in the axial and tangential directions in the rudder plane are shown in Table 1. The axial and tangential velocities have been normalized by the ship speed ($V_o$). The advanced coefficient (J) used is 1.236, the advance coefficient of a typical Navy destroyer. Velocity components in the ship wake obtained from a towing tank wake survey behind a typical Naval destroyer hull model have been used as input velocities in these calculations. Wake survey data represents velocity components measured in the propeller plane in the absence of the propeller. Thus, results presented in Table 1 represent onset flow angles into the rudder plane behind a ship hull.

The leading edge of tapered rudders are conventionally located a distance of between approximately 1.3 to 1.4 times the propeller radius aft of the propeller plane. Therefore, the following results cover that approximate range in order to predict the onset flow angle into the leading edge of the rudder.

TABLE 1

| | Onset flow angles into the rudder plane | | | |
|---|---|---|---|---|
| X/R | Y/R | $V_x/V_o$ | $-V_t/V_o$ | $-\alpha_{X,Y}$ |
| 1.370 | 0.434 | 1.256 | 0.155 | 7.04° |
| 1.350 | 0.513 | 1.264 | 0.146 | 6.59° |
| 1.329 | 0.592 | 1.272 | 0.126 | 5.66° |
| 1.309 | 0.671 | 1.264 | 0.016 | 4.79° |

The computed onset flow angles entering the rudder plane near the leading edge of a conventionally located tapered rudder are found to be on the order of 4 to 7 degrees. Again, such rudders experience large onset flow angles. Large suction pressure peaks are expected to occur at the rudder leading edge. In the case of twin rudders behind twin outboard rotating propellers (starboard propeller turning clockwise and port propeller turning counterclockwise) the flow into the rudder plane is in the outboard direction, resulting in cavitation on the outboard sides of each rudder.

In this example, the rudder of the present invention would be aligned with the flow by rotating the profiles at Y/R= 0.434, 0.513, 0.592 and 0.671 angles equal to $\alpha_{X,Y}$ so that the mean chordline would be aligned with $\alpha_{X,Y}$. The remaining profiles would be faired into the rotated profiles to produce a faired rudder surface. X, Y and Z coordinates of the rudder surface could then be determined using, for example, any of numerous well known computer aided design/computer aided manufacturing (CAD/CAM) software packages. The data could then be input into, for example, a numerical cutting or milling machine to produce the finished product.

Although in this example a matrix of only four points is used in determining the onset flow angle, the present invention is applicable to matrices of any size. Thus, a matrix could comprises a single point in each of the profiles, with the points being substantially aligned in the spanwise direction and thus defining a single substantially spanwise line in the rudder plane. In such a case, each point would define a rotation point and the twisting step would comprises rotating each profiles about its corresponding rotation points whereby each of the profiles along the entirety of the span would experience a substantially zero angle of attack. Each of the rotation points preferably has a chordwise location between the leading edge and 30% of the chord behind the leading edge. However, the points need not be vertically aligned and could be located in any chordwise location dictated by performance considerations, such as for example, the center of pressure or lift of each profile.

Furthermore, the matrix may comprise a plurality of points in each of the profiles such that the matrix defines a plurality of spanwise points and a plurality of chordwise points. In such a case a line drawn tangent to the mean chordline of the resulting twisted profile at each matrix point would define a twist angle. The rudder would be aligned with the flow into the rudder by sequentially rotating the rudder profile, starting at the forward most matrix point in the profile and moving aft, such that the resulting twist angles would be substantially equal to the calculated onset flow angle at each corresponding matrix point. Thus, each chordline is aligned with the direction of the fluid flow at each of the points in the matrix whereby the rudder experiences a substantially zero angle of attack over the entirety of the matrix.

EXAMPLE 3

To quantify the effect of onset flow angles on rudder cavitation, a lifting surface program was linked to MIT PSF 10 as modified. The lifting surface program uses the computed velocity components to calculate pressure distributions on the rudder surface. Pressure distributions were determined for a conventional rudder having no twist and for the twisted rudder of Example 2. The rudders have identical symmetric NACA 4-digit profiles. FIGS. 11A, 11B, 12A and 12B present the computed negative pressure coefficient, –Cp, plotted against the fraction of chord, x/C, for profiles located at Y/R=0.42 and 0.58. The two lines in each figure represent calculated pressure coefficients on the inboard (I) and outboard (0) surfaces of a rudder behind an outboard rotating propeller of a twin shaft vessel.

Figure 11A:
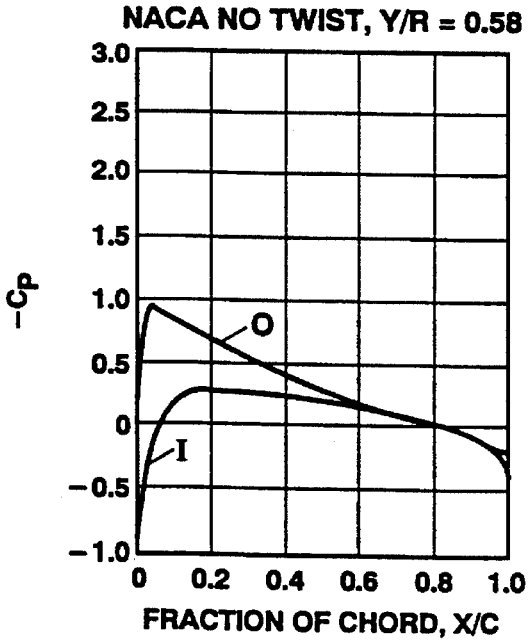
FIGS. 11A and 11B contain graphs of computed pressure distributions at two rudder sections of a conventional non-twisted rudder.
Figure 11B:
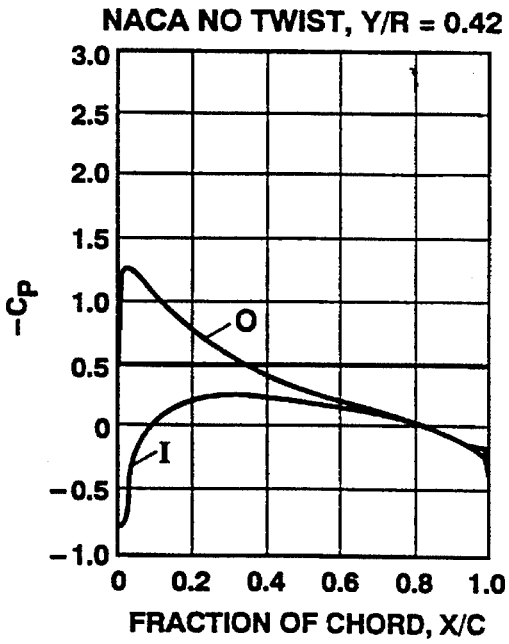

FIGS. 11A and 11B present results for the conventional rudder with no twist and with the mean chordline of each symmetric profile parallel to the ship centerline. As expected, the rudder has large leading edge suction pressure peaks at all radii calculated. At Y/R=0.42, the suction pressure peak rises to $-Cp_{min}=1.25$, according to the formula $$C_p = \frac{p - p_o}{1/2\rho V_o^2}$$

where ρ, P, and $p_o$ denote the fluid density, local pressure on the rudder surface, and reference pressure, respectively.

Figure 12A:
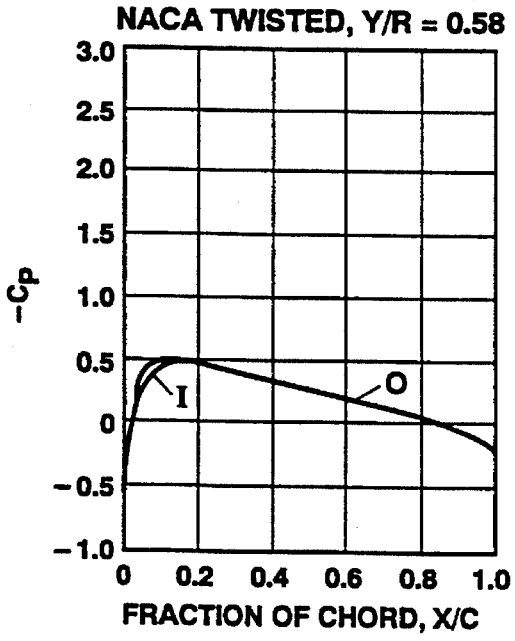
FIGS. 12A and 12B contain graphs of computed pressure distributions at two rudder sections of a twisted rudder of the present invention.
Figure 12B:
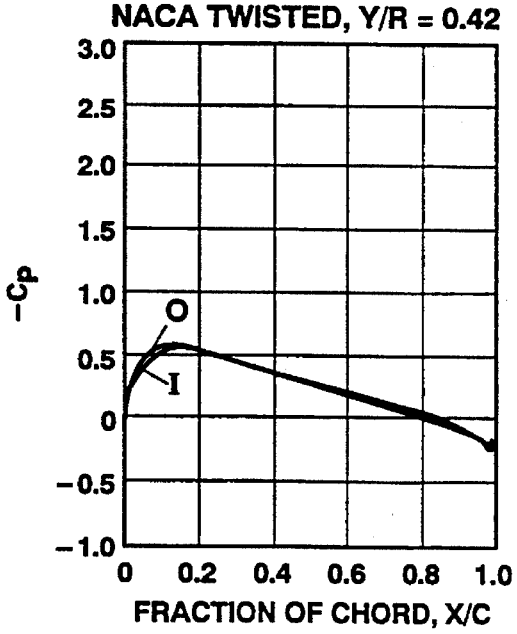

FIGS. 12A and 12B present results for the twisted rudder of the present invention twisted by the values given in Table 1. Thus, the profiles are parallel to the onset flow angles and not to the ship centerline. The computed pressure coefficient of the twisted rudder at Y/R=0.42 is $-Cpm_{min}=0.6$ which is substantially lower than the value of 1.25 for the non-twisted rudder. This result indicates that the swirl produced by the rotating propeller has been effectively countered with the twisted rudder of the present invention.

σ denotes the cavitation number according to the formula $$\sigma = \frac{p_o - p_v}{1/2\rho V_o^2}$$

where $P_v$ is the vapor pressure. When the hydrostatic head and the vapor pressure terms are kept constant, the classic scaling law gives cavitation inception speeds for twisted rudders versus non-twisted rudders as $$\begin{aligned} V_{twist}/V_{non\text{-}twist} &= (\sigma_{non\text{-}twist}/\sigma_{twist})^{0.5} \\ &= (-Cpmin_{non\text{-}twist}/-Cpmin_{twist})^{0.5} \\ &= 1.44 \end{aligned}$$

An increase in rudder cavitation inception speed of 44% results with the rudder twisted according to Example 2 when the ship is operated in a straight ahead course. Furthermore, since the twisted rudder decreases the initial angle seen by the rudder by an amount equal to the calculated onset flow angle, the twisted rudder will also reduce suction pressure peaks during course-keeping and maneuvering. Thus, with propeller induced swirl properly compensated for, rudder cavitation will be minimized or suppressed during course-keeping or turning operation of the vessel.

It is further noted that the stall angle of NACA 4-digit profiles is approximately 26 to 30 degrees, depending on Reynolds number and profile thickness. However, since the conventional non-twisted rudder in straight ahead operation experiences a 4 to 7 degree onset flow angle, the rudder will stall at an angle smaller that the stall angle (the stall angle minus the onset flow angle). Twisted rudders of the present invention, by aligning the profiles with the onset flow angle, can recover 4 to 7 degrees in available angle before stall.

The advantages of the present invention are numerous.

The twisted rudder and method of the present invention are easily adapted to any vessel configuration, including surface and subsurface ships having one or more propellers.

With the recent advance in application of numerical cutting machines, no extra cost is to be expected in the fabrication of a twisted rudder as compared to a non-twisted rudder.

The rudder provides higher cavitation inception speeds and thus improved hydrodynamic and acoustic performance.

The present method is easily applied and provides increased cavitation inception speed for a rudder.

Furthermore, the invention provides quieter ship operation, reduced cavitation erosion, reduced rudder drag, and delayed rudder stall. Consequently, unsteady forces arising from rudder cavitation are suppressed or minimized and thus wear on the rudder, rudder stock, stock bearing and vessel are reduced. Thus, cost savings can be realized by increasing time between replacement of parts.

The present invention and many of its attendant advantages will be understood from the foregoing description and it will be apparent to those skilled in the art to which the invention relates that various modifications may be made in the form, construction and arrangement of the elements or steps of the invention described herein without departing from the spirit and scope of the invention or sacrificing all of its material advantages. The forms of the present invention herein described are not intended to be limiting but are merely preferred or exemplary embodiments thereof.

What is claimed is:

1. A method of twisting a rudder to substantially align said rudder with a direction of a fluid flow into said rudder, a resulting twisted rudder being located substantially about a vertical plane aft of a rotating ship propeller, said twisted rudder having a chord and a span, said chord and span defining a curved locus of points, said rudder operating in the fluid flow behind said rotating propeller, said rotating propeller imparting to the fluid flow an induced flow angle that varies in a spanwise and a chordwise direction, the induced flow angle defining an onset flow angle into said rudder, said method comprising the steps of:

providing a plurality of rudder profiles extending between a leading edge and a trailing edge, each of said profiles having a mean chordline, said profiles spaced in a spanwise direction of said vertical plane and defining an untwisted rudder shape;

providing a matrix of points in said vertical plane, said matrix comprising a plurality of points in each of said profiles such that said matrix defines a plurality of spanwise points and a plurality of chordwise points in said vertical plane, each of said profiles having associated therewith a thickness measured normal to said mean chordline at each of said plurality of points, said thickness varying between said leading edge and said trailing edge, each of said plurality of points defining a rotation point, said rotation points including a forward most rotation point and an aft most rotation point, each of said rotation points defining a corresponding rotation axis perpendicular to said profile at said rotation point;

determining said onset flow angle behind said rotating propeller at each of said points in said matrix; and rotating each of said profiles sequentially from said forward most rotation point to said aft most rotation point about said corresponding rotation axes such that a rotated mean chordline is formed thereby and wherein a tangent to said rotated mean chordline at each of said rotation points defines a twist angle, said resulting twist angles being substantially equal to said onset flow angles at corresponding rotation points such that each of said rotated mean chordlines are substantially aligned with the direction of the fluid flow at each of said corresponding points in said matrix, further wherein each of said rotated profiles has associated therewith a rotated thickness measured normal to said rotated mean chordline at each of said rotation points, said rotated thickness at each of said rotation points being equal to said thickness measured normal to said mean chordline at each of said plurality of points, said rotating forming a plurality of rotated profiles defining said twisted rudder.

2. A method as in claim 1, wherein each of said forward most rotation points has a chordwise location between said leading edge and 30% of said chord behind said leading edge and each of said aft most rotation points has a location between said trailing edge and 30% of said chord forward of said trailing edge.

3. A method as in claim 1, wherein said first providing step includes providing profiles having first and second arcuate surfaces that are symmetric about said mean chordline between said leading edge and said trailing edge.

4. A method as in claim 1, wherein said first providing step includes providing profiles having first and second cambered surfaces that are asymmetric about said mean chordline.

5. A method as in claim 1, wherein said first providing step includes providing profiles having airfoil shaped sections.

6. A rudder for a vessel, said rudder operating in a fluid flow behind a rotating propeller which imparts to the fluid flow induced flow angles that vary in a spanwise and a chordwise direction, the induced flow angles defining onset flow angles into said rudder, said rudder comprising:

a leading edge and a trailing edge defining a rudder chord;

a root and a tip defining a rudder span;

said rudder chord and said rudder span defining a curved locus of points;

a plurality of chordwise extending profiles having arcuate first and second surfaces extending between said leading and trailing edges, said profiles spaced in a spanwise direction and defining a shape of said rudder, each of said profiles having a mean chordline, said mean chordlines defining angles of attack of said profiles relative to onset flow angles into said profiles, wherein each of said mean chordlines defines a curved line and further wherein tangent lines at a plurality of points along each of said mean chordlines define substantially 0° angles relative to said onset flow angle at corresponding points of said mean chordlines wherein each of said mean chordlines is substantially aligned with the onset flow angle into corresponding profiles whereby each of said profiles experiences a substantially zero angle of attack; and each of said profiles being faired into adjacent profiles such that said profiles define a faired rudder shape having no sharp discontinuities between adjacent profiles.

7. A rudder as in claim 6, wherein said profiles have first and second cambered surfaces that are asymmetric about said mean chordline.

8. A rudder as in claim 6, wherein said profiles are airfoil sections.

* * * * *